US011143067B2

(12) United States Patent
Kang et al.

(10) Patent No.: US 11,143,067 B2
(45) Date of Patent: Oct. 12, 2021

(54) RELIEF VALVE FOR OIL PUMP HAVING SEPARATED BYPASS PERIOD

(71) Applicants: Hyundai Motor Company, Seoul (KR); Kia Motors Corporation, Seoul (KR)

(72) Inventors: Dong-Hun Kang, Seoul (KR); Tae-Gyun Kim, Uiwang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/886,701

(22) Filed: May 28, 2020

(65) Prior Publication Data

US 2021/0180482 A1 Jun. 17, 2021

(30) Foreign Application Priority Data

Dec. 12, 2019 (KR) ..... 10-2019-0165729

(51) Int. Cl.

| | |
|---|---|
| ***F01M 1/16*** | (2006.01) |
| ***F01M 1/14*** | (2006.01) |
| ***F01M 1/20*** | (2006.01) |
| *F01M 1/02* | (2006.01) |

(52) U.S. Cl.

CPC ..... *F01M 1/16* (2013.01); *F01M 1/14* (2013.01); *F01M 1/20* (2013.01); *F01M 2001/0238* (2013.01); *F01M 2250/62* (2013.01); *F02D 2200/024* (2013.01)

(58) Field of Classification Search

CPC .. F01M 1/16; F01M 1/14; F01M 1/20; F01M 2001/0238; F01M 2250/62; F02D 2200/024

USPC ..... 123/196 CP

See application file for complete search history.

(56) References Cited

U.S. PATENT DOCUMENTS

| | | | | |
|---|---|---|---|---|
| 5,339,776 | A | 8/1994 | Regueiro | |
| 5,547,349 | A * | 8/1996 | Kimura | F01M 1/16 417/282 |
| 6,626,141 | B2 | 9/2003 | Choi | |
| 7,011,069 | B2 * | 3/2006 | Ono | F04C 14/065 123/196 R |
| 7,588,011 | B2 * | 9/2009 | Ono | F04C 2/102 123/196 R |
| 2002/0034449 | A1 | 3/2002 | Hojyo et al. | |

(Continued)

FOREIGN PATENT DOCUMENTS

KR 20020021060 A 3/2002

*Primary Examiner* — Mahmoud Gimie

(74) *Attorney, Agent, or Firm* — Slater Matsil, LLP

(57) ABSTRACT

A method of operating a relief valve assembly for an oil pump includes unblocking a first bypass inlet passage and blocking a first bypass outlet passage, a second bypass inlet passage, and a second bypass outlet passage with a plunger, introducing oil to the relief valve assembly, moving the plunger in a downward direction by a first displacement to unblock the first bypass outlet passage, starting a first bypass of the oil, moving the plunger in the downward direction by a second displacement to block the first bypass inlet passage and unblock the second bypass inlet passage, terminating the first bypass of the oil, moving the plunger in the downward direction by a third displacement to unblock the second bypass outlet passage, and starting a second bypass of the oil.

20 Claims, 10 Drawing Sheets

(56) References Cited

U.S. PATENT DOCUMENTS

| | | | |
|---|---|---|---|
| 2012/0118257 | A1 | 5/2012 | Chung |
| 2014/0182714 | A1 | 7/2014 | Shin |

* cited by examiner

RELIEF VALVE FOR OIL PUMP HAVING SEPARATED BYPASS PERIOD

CROSS-REFERENCE TO RELATED APPLICATIONS

This application claims priority to Korean Patent Application No. 10-2019-0165729, filed on Dec. 12, 2019, which application is hereby incorporated herein by reference.

TECHNICAL FIELD

The present disclosure relates to a relief valve for an oil pump having a separated bypass period.

BACKGROUND

In an engine of a vehicle, for lubrication of a friction part, oil is pressurized in an oil pump and supplied.

The oil pump includes an outer rotor and an inner rotor that rotate inscribed with each other in a housing. The oil introduced into a suction port is pressurized while passing through the outer rotor and the inner rotor, which rotate relatively, and then is discharged through a discharge port to be supplied to the lubrication part.

When the oil has an excessively high pressure in a lubrication system of the vehicle, degradations in durability of the lubrication system and in fuel efficiency are caused.

In order to prevent the above degradations and maintain a constant pressure, a relief valve assembly is provided in the oil pump. The relief valve assembly allows a plunger to ascend or descend in a valve housing, which is formed on a bypass passage for communicating the discharge port with the suction port of the oil pump, to open the bypass passage, thereby releasing a pressure in the oil pump.

The bypass passage is connected to an upper end of the valve housing to allow the pressurized oil to move the plunger downward. When the plunger is moved downward, a first bypass inlet passage connected to the bypass passage communicates with a first bypass outlet passage and the oil bypasses first.

Thereafter, when the pressurized oil is continuously provided to the bypass passage, the bypass passage bypasses the pressurized oil to the suction port by passing through from the second bypass inlet passage to the second bypass outlet passage.

When the oil pump is operating, the plunger ascends or descends in the relief valve assembly 20 and repeats the first bypass and a second bypass to adjust the pressure of the oil discharged from the oil pump.

As described above, in the relief valve assembly for bypassing the oil in two stages, when a first bypass section overlaps a second bypass section or the second bypass proceeds immediately after the first bypass, since an amount of the oil discharged from the oil pump 1 is not sufficient after the first bypass, a low oil pressure is formed in a high speed operating section of the engine.

SUMMARY

Exemplary embodiments of the present disclosure relate to a relief valve assembly provided in an oil pump for supplying oil for lubrication of an engine of a vehicle and controlling a pressure of oil discharged from the oil pump. Particular embodiments relate to a relief valve assembly for an oil pump that separates a bypass section to secure a pressure and a flow rate after a pressure of oil, which is pressurized in the oil pump, is decreased.

An embodiment of the present disclosure is directed to a relief valve assembly for an oil pump in which a bypass section is separated so as to secure a flow rate of oil discharged from the oil pump after a first bypass to prevent lowering of the oil pressure by forming an interval between a first bypass section and a second bypass section.

Other objects and advantages of the present disclosure can be understood by the following description and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an embodiment of the present disclosure, there is provided a relief valve assembly for an oil pump in which a bypass section is separated and which is installed on a bypass passage for connecting a discharge port and a suction port in an oil pump in which an outer rotor and an inner rotor rotate to be inscribed with each other and controls a pressure of oil discharged from the oil pump by opening or closing oil returned through the bypass passage, the relief valve assembly including a plunger slidably installed in a valve housing formed on one side of the oil pump and configured to be elastically supported in a direction of blocking a flow of the oil, wherein a bypass inlet passage and a bypass outlet passage, which are opened and closed according to movement of the plunger while communicating the bypass passage with an interior of the valve housing, are formed as two or more at intervals and the bypass inlet passage and the bypass outlet passage which correspond to each other bypass the oil, and when the plunger moves downward, the bypass inlet passage and the bypass outlet passage, which communicate with each other, are blocked first, and then the bypass inlet passage communicates with the bypass outlet passage after a predetermined interval.

The bypass inlet passage may include a first bypass inlet passage and a second bypass inlet passage formed above the first bypass inlet passage, and the bypass outlet passage may include a first bypass outlet passage formed below the first bypass inlet passage and a second bypass outlet passage formed between the first bypass inlet passage and the second bypass inlet passage.

When the plunger descends, the first bypass inlet passage and the first bypass outlet passage are opened first, and thus the first bypass inlet passage communicates with the first bypass outlet passage so that the oil may be bypassed first, and when the plunger continues to descend, the first bypass inlet passage may be blocked, the second bypass inlet passage and the second bypass outlet passage may be opened after a predetermined interval, and then the second bypass inlet passage may communicate with the second bypass outlet passage so that the oil may be bypassed second.

The plunger may include an upper body and a lower body formed at a predetermined interval in a length direction of the plunger, the lower body may open or close the first bypass outlet passage, and the upper body may open or close the first bypass inlet passage and the second bypass outlet passage.

When the plunger descends, the first bypass inlet passage may be started to be blocked in a state in which the second bypass outlet passage is blocked, and after the closing of the first bypass inlet passage is completed and a predetermined interval passes, the second bypass outlet passage may be opened.

When the plunger further descends in a range from 1 mm to 2 mm after the closing of the first bypass inlet passage is completed, the second bypass outlet passage may be opened.

After an upper end of the upper body of the plunger is further spaced apart from an upper end of the second bypass outlet passage and thus the closing of the first bypass inlet passage is completed, the second bypass outlet passage may be opened after a predetermined interval.

The upper end of the upper body extends above the plunger such that the upper end of the upper body of the plunger may be further spaced apart from the upper end of the second bypass outlet passage.

The upper end of the second bypass outlet passage may be formed below the plunger such that the upper end of the second bypass outlet passage may be further spaced apart from the upper end of the upper body of the plunger.

An inclined portion having a cross section, which is decreased from the upper body toward the lower body, may be formed between the upper body and the lower body of the plunger, and a lower opening portion having a diameter equal to that of an end portion of the inclined portion may be formed between the inclined portion and the lower body.

A tapered portion having an inclined cross section may be formed on a circumference of an upper end of the upper body in the plunger.

DETAILED DESCRIPTION OF ILLUSTRATIVE EMBODIMENTS

Hereinafter, a relief valve assembly for an oil pump in which a bypass section is separated according to embodiments of the present disclosure will be described in detail with reference to the accompanying drawings.

Figure 1:
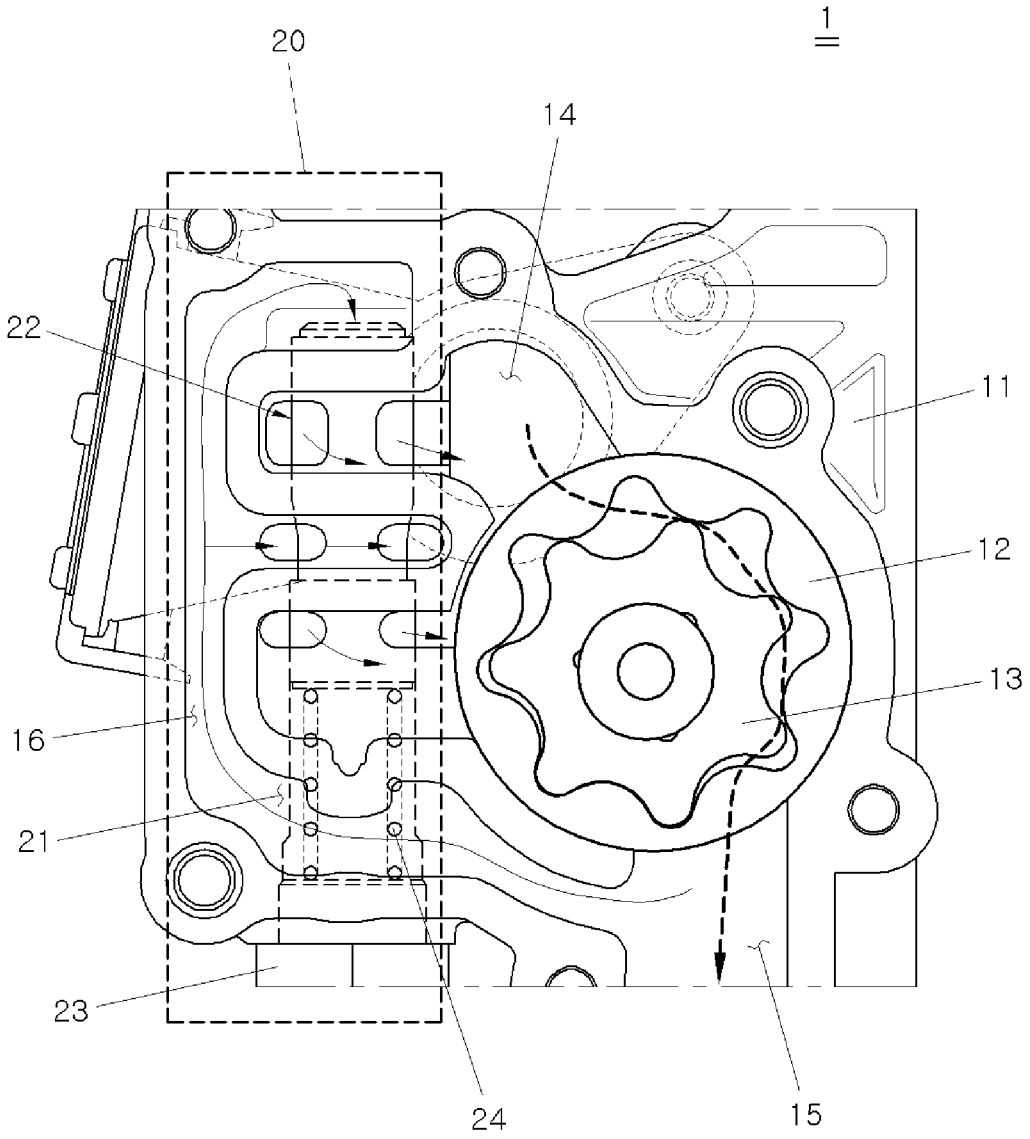
FIG. 1 is a cross-sectional view illustrating a configuration of an oil pump to which a relief valve assembly according to embodiments of the present disclosure is applied.

FIG. 1 is a cross-sectional view illustrating a configuration of an oil pump to which a relief valve assembly according to embodiments of the present disclosure is applied. The oil pump 1 includes an outer rotor 12 and an inner rotor 13 which rotate inscribed with each other in a housing ii. The oil introduced into a suction port 14 is pressurized while passing through the outer rotor 12 and the inner rotor 13, which rotate relatively, and then is discharged through a discharge port 15 to be supplied to the lubrication part.

When the oil has an excessively high pressure in a lubrication system of the vehicle, degradations in durability of the lubrication system and in fuel efficiency are caused.

In order to prevent the above degradations and maintain a constant pressure, a relief valve assembly 20 is provided in the oil pump 1. The relief valve assembly 20 allows a plunger 22 to ascend or descend in a valve housing 21, which is formed on a bypass passage 16 for communicating the discharge port 15 with the suction port 14 of the oil pump 1, to open the bypass passage 16, thereby releasing a pressure in the oil pump 1.

Figure 2:
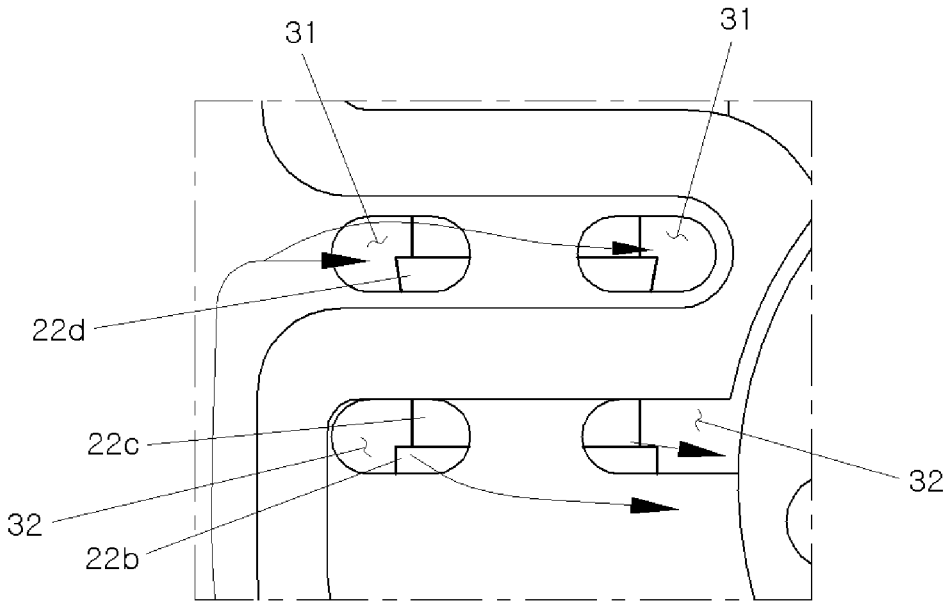
FIG. 2 is a cross-sectional view illustrating a first bypass state in the relief valve assembly for an oil pump, in which the bypass section is separated according to embodiments of the present disclosure.

The bypass passage 16 is connected to an upper end of the valve housing 21 to allow the pressurized oil to move the plunger 22 downward. When the plunger 22 is moved downward, a first bypass inlet passage 31 connected to the bypass passage 16 communicates with a first bypass outlet passage 32, and the oil bypasses first (see FIG. 2).

Figure 3:
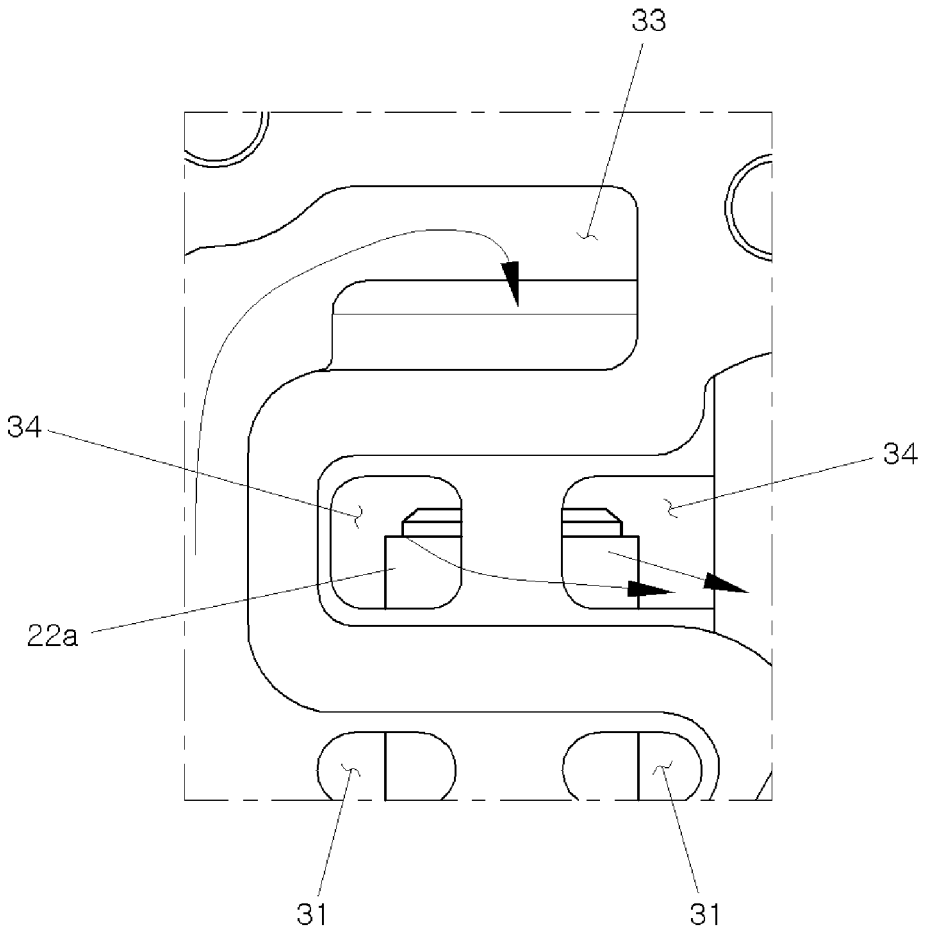
FIG. 3 is a cross-sectional view illustrating a second bypass state in the relief valve assembly for an oil pump, in which the bypass section is separated according to embodiments of the present disclosure.
Figure 4:
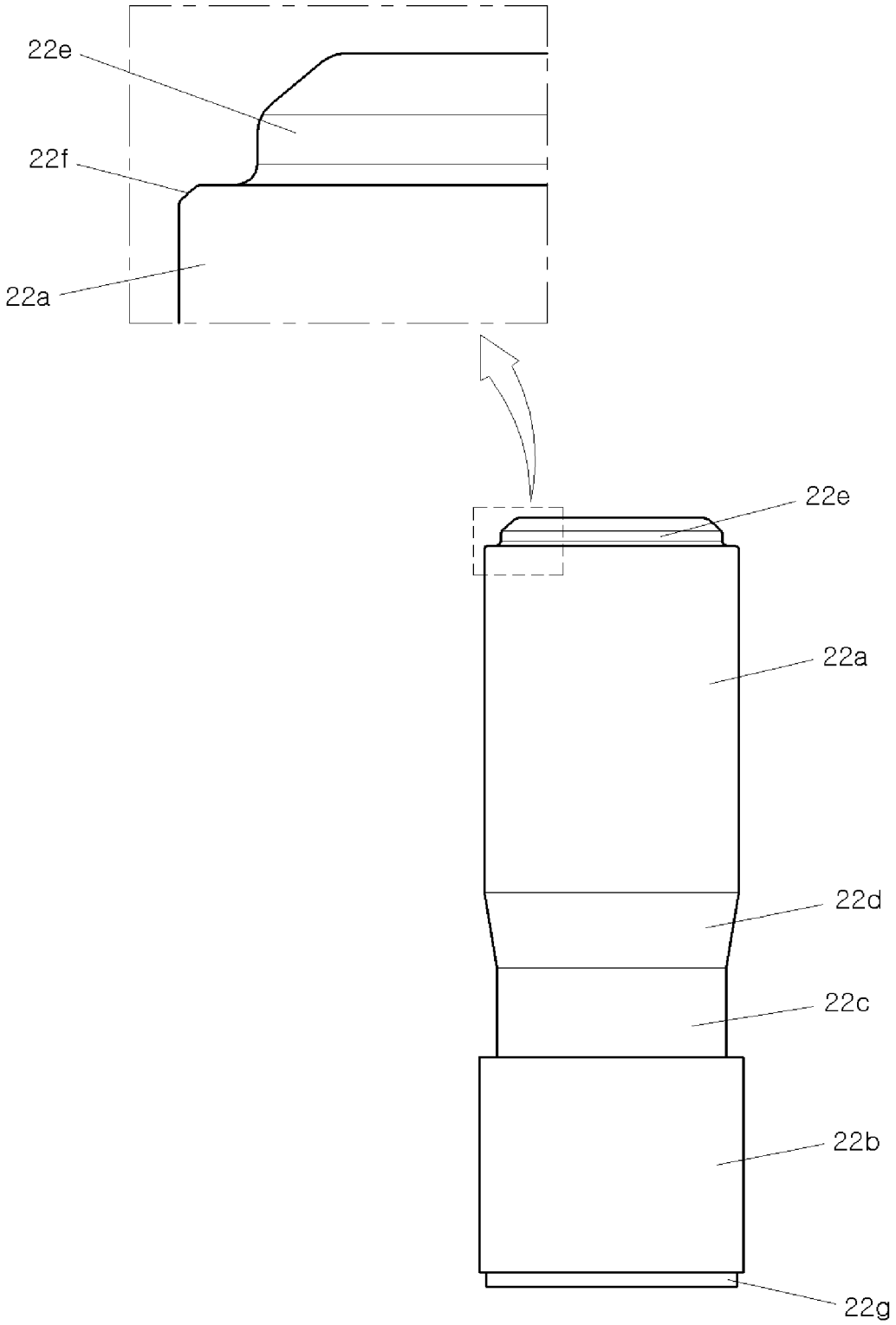
FIG. 4 is a front view illustrating a plunger provided in the relief valve assembly for an oil pump in which the bypass section is separated according to embodiments of the present disclosure.

Thereafter, when the pressurized oil is continuously provided to the bypass passage 16, the bypass passage 16 bypasses the pressurized oil to the suction port 14 by passing through from the second bypass inlet passage 33 to the second bypass outlet passage 34 (see FIG. 3).

When the oil pump 1 is operating, the plunger 22 ascends or descends in the relief valve assembly 20 and repeats the first bypass and a second bypass to adjust the pressure of the oil discharged from the oil pump 1.

As described above, in the relief valve assembly 20 for bypassing the oil in two stages, when a first bypass section overlaps a second bypass section or the second bypass proceeds immediately after the first bypass, since an amount of the oil discharged from the oil pump 1 is not sufficient after the first bypass, a low oil pressure is formed in a high speed operating section of the engine.

The relief valve assembly for an oil pump in which a bypass section is separated according to embodiments of the present disclosure includes a plunger 22 slidably installed in a valve housing 21 formed on one side of an oil pump 1 and elastically supported in a direction for blocking a flow of oil. In the relief valve assembly, bypass inlet passages 31 and 33 and bypass outlet passages 32 and 34, which are opened and closed according to movement of the plunger 22 while communicating a bypass passage 16 with an interior of the valve housing 21, are formed as two or more passages, the bypass inlet passages 31 and 33 communicate with the bypass outlet passages 32 and 34, which correspond to each other, bypass the oil, and, when the plunger 22 moves downward, the bypass inlet passage 31 and the bypass outlet passage 32, which communicate with each other, are blocked first, and then, after a predetermined interval, the bypass inlet passage 33 communicates with the bypass outlet passage 34.

In the oil pump 1, an outer rotor 12 and an inner rotor 13 rotate to be inscribed with each other in a housing ii and the suction port 14 pressurizes introduced oil to discharge the pressurized oil through a discharge port 15.

In order to prevent degradations in durability and fuel efficiency in a lubrication system due to an excessively high pressure in the lubrication system of an engine, the oil pump 1 returns the oil in a section in which oil of a high pressure is not needed. That is, the bypass passage 16 is formed to communicate the discharge port 15 with the suction port 14, and a relief valve assembly 20 is provided on the bypass passage 16 to control a pressure and a flow rate of the oil discharged from the oil pump 1.

The relief valve assembly 20 includes the plunger 22 slidably installed in the valve housing 21 formed at one side of the oil pump 1. The plunger 22 is elastically supported in a direction, e.g., an upward direction, for blocking a flow of the oil through the relief valve assembly 20 due to a spring 24 fixed by a holder 23.

The bypass inlet passages 31 and 33 and the bypass outlet passages 32 and 34 are formed to be spaced from each other by a gap, wherein the bypass inlet passages 31 and 33 and the bypass outlet passages 32 and 34 are opened and closed according to the movement of the plunger 22 while communicating with the bypass passage 16 and the interior of the valve housing 21.

A bypass is sequentially generated as a first bypass and a second bypass according to the movement of the plunger 22, and the first bypass and the second bypass are generated at a predetermined interval.

Thus, in the housing ii, the first bypass outlet passage 32, the first bypass inlet passage 31, the second bypass outlet passage 34, and the second bypass inlet passage 33 are sequentially formed from a lower side to an upper side of the plunger 22. While descending, the plunger 22 communicates the first bypass inlet passage 31 with the first bypass outlet passage 32 so that the oil is bypassed first. Thereafter, the plunger 22 further descends to block the communication between the first bypass inlet passage 31 and the first bypass outlet passage 32 and communicate the second bypass inlet passage 33 with the second bypass outlet passage 34 so that the oil is bypassed second.

To describe a shape of the plunger 22, an upper body 22*a* and a lower body 22*b* are formed to be spaced apart from each other. In the plunger 22, an inclined portion 22*d* having a cross section reduced from the upper body 22*a* toward the lower body 22*b* is formed between the upper body 22*a* and the lower body 22*b*, and a lower opening portion 22*c* having a diameter equal to that of an end portion of the inclined portion 22*d* is formed between the inclined portion 22*d* and the lower body 22*b*. A spring seat 22*g* on which the spring 24 is seated is formed on a lower end of the plunger 22, and an upper opening and closing portion 22*e*, which is in contact with or spaced apart from the second bypass inlet passage 33 and is capable of blocking or opening the second bypass inlet passage 33, is formed on an upper end of the plunger 22.

At an initial position of the plunger 22, the inclined portion 22*d* and the lower opening portion 22*c* are located at the first bypass inlet passage 31 to be in a state of opening the first bypass inlet passage 31. However, the upper opening and closing portion 22*e* is in a state of blocking the second bypass inlet passage 33, the upper body 22*a* is in a state of blocking the second bypass outlet passage 34, and the lower body 22*b* is in a state of blocking the first bypass outlet passage 32. Thereafter, according to the displacement of the plunger 22 while the plunger 22 descends, the first bypass inlet passage 31, the first bypass outlet passage 32, the second bypass inlet passage 33, and the second bypass outlet passage 34 are opened or closed so that a first bypass (the first bypass inlet passage 31 communicates with the first bypass outlet passage 32) and a second bypass (the second bypass inlet passage 33 communicates with the second bypass outlet passage 34) are sequentially made. For example, when the plunger 22 moves downward by as much as a displacement a, the first bypass is started, and, when the plunger 22 moves downward by as much as a displacement b, the first bypass is terminated, and, when the plunger 22 moves downward by as much as a displacement c, the second bypass is started.

Here, the displacement a, the displacement b, and the displacement c may be 4 mm, 7 mm, and 8 mm, respectively.

In particular, in embodiments of the present disclosure, after the first bypass is terminated, there is a predetermined interval before the second bypass is started. That is, when the plunger 22 continues to descend, there is a predetermined interval between a point in time when the first bypass inlet passage 31 is blocked at which the first bypass is terminated and a point in time when the second bypass outlet 34 is opened at which the second bypass is started so that a flow rate and a pressure of the oil discharged from the oil pump 1 are secured.

That is, the point in time when the blocking of the first bypass inlet passage 31 is completed is shortened or the point in time when the opening of the second bypass inlet passage 33 is retarded.

As a specific method, a shape of the plunger 22 is adjusted or a position of the second bypass inlet passage 33 is adjusted so that an opening time of the second bypass inlet passage 33 may be retarded.

For example, an upper end of the upper body 22*a* of the plunger 22 is further spaced apart from an upper end of the second bypass outlet passage 34 so that an opening time of the second bypass outlet passage 34 is retarded to form an interval between the first bypass and the second bypass.

Figure 5A:
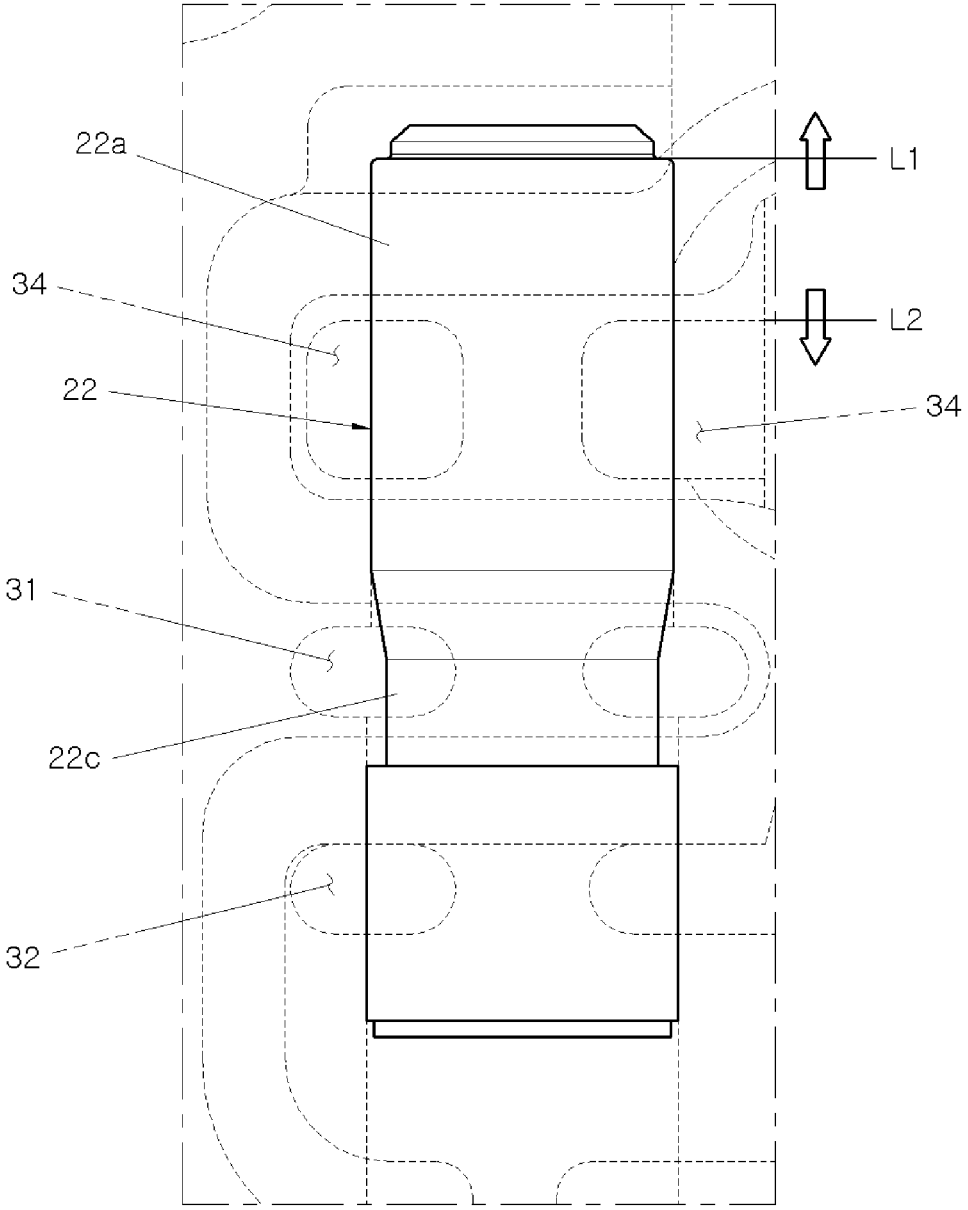
FIGS. 5A to 5D are cross-sectional views illustrating a state according to a descending of the plunger in the relief valve assembly for an oil pump in which the bypass section is separated according to embodiments of the present disclosure.

Accordingly, the upper end of the upper body 22*a* may extend above the plunger 22 so that the upper end of the upper body 22*a* of the plunger 22 is further separated from the upper end of the second bypass outlet passage 34. In FIG. 5A, a position of the upper end of the upper body 22*a* has been shown as $L_1$. However, as compared with a conventional relief valve assembly, when the position $L_1$ of the upper end of the upper body 22*a* is moved above the plunger 22, the opening time of the second bypass outlet passage 34 is retarded so that an interval is formed between the first bypass and the second bypass.

Alternatively, the upper end of the second bypass outlet passage 34 may be formed below the plunger 22 so as to be further spaced apart from the upper end of the upper body 22*a* of the plunger 22. That is, in FIG. 5A, a position of the upper end of the second bypass outlet passage 34 has been shown as L2. However, as compared with a conventional relief valve assembly, when the position L2 of the upper end of the second bypass outlet passage 34 is moved below the plunger 22, the opening time of the second bypass outlet passage 34 is also retarded so that an interval is formed between the first bypass and the second bypass.

Here, when the displacement b and the displacement c are formed as 7 mm and 8 mm, respectively, an interval is formed between the first bypass and the second bypass while the plunger 22 descends by as much as 1 mm. The displacement of the plunger 22 in which the first bypass and the second bypass are generated has been suggested as 1 mm, but may range from 1 mm to 2 mm.

When the position L2 of the upper end of the second bypass outlet passage 34 is moved below the plunger 22 in a state in which a width or a position of a lower end of the second bypass outlet passage 34 remains, the area of the second bypass outlet passage 34 is decreased.

Further, the interval between the first bypass and the second bypass is set in consideration of fuel efficiency and noise, vibration, and harshness (NVH). As the interval between the first bypass and the second bypass is increased, a pressure of oil discharged from the oil pump 1 is gradually increased so that it is advantageous in terms of the NVH. However, an oil pressure increase revolution per minute (RPM) is decreased so that it is disadvantageous in terms of fuel efficiency. In consideration of the NVH, the interval between the first bypass and the second bypass gradually increases the pressure of the oil and a sufficient pressure and a sufficient flow rate are discharged at a high pressure so that it is advantageous for the interval to be long. However, when the interval becomes longer, it is disadvantageous in terms of fuel efficiency so that a compromised value should be taken in consideration of the NVH and the fuel efficiency.

Meanwhile, an inclined tapered portion 22*f* is formed on a circumference of the upper end of the upper body 22*a* in the plunger 22 so that, when the second bypass outlet passage 34 is opened, generation of a drastic variation in flow rate is prevented.

An operation of the relief valve assembly for an oil pump having the above configuration in which the bypass section is separated according to embodiments of the present disclosure will be described below.

FIG. 5A illustrates a state prior to an operation of the relief valve assembly 20.

The plunger 22 is in a state of blocking the first bypass outlet passage 32, the second bypass inlet passage 33, and the second bypass outlet passage 34. Since the first bypass inlet passage 31 is in an opened state but the first bypass outlet passage 32 is in a blocked state, the first bypass inlet passage 31 does not communicate with the first bypass outlet passage 32 so that the oil is not returned through the relief valve assembly 20.

When a pressure of the oil discharged from the oil pump 1 is high due to the operation of the oil pump 1, some of the oil is returned to the relief valve assembly 20 through the bypass passage 16. When the plunger 22 is started to move in a descending direction due to the pressure of the oil, the first bypass outlet passage 32 is additionally opened in a state in which the first bypass inlet passage 31 is opened so that the first bypass inlet passage 31 communicates with the first bypass outlet passage 32.

Figure 5B:
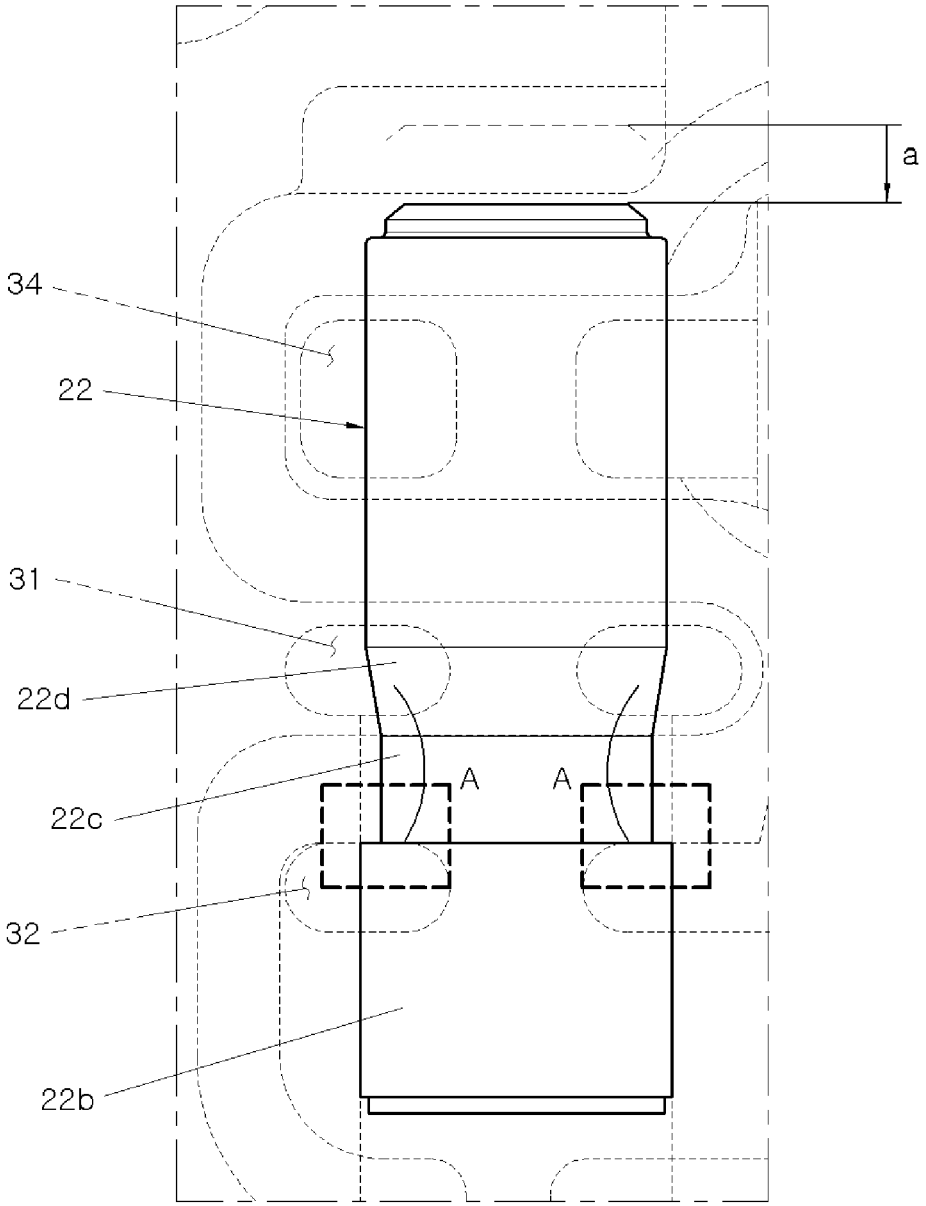

For example, as shown in FIG. 5B, when the plunger 22 descends by as much as the displacement a, the first bypass outlet passage 32 is additionally started to be opened in a state in which the first bypass inlet passage 31 is opened so that the oil is started to bypass first (see Portion A of FIG. 5B). In this case, the first bypass inlet passage 31 may be started to be blocked due to descending of the upper body 22*a* of the plunger 22.

Figure 5C:
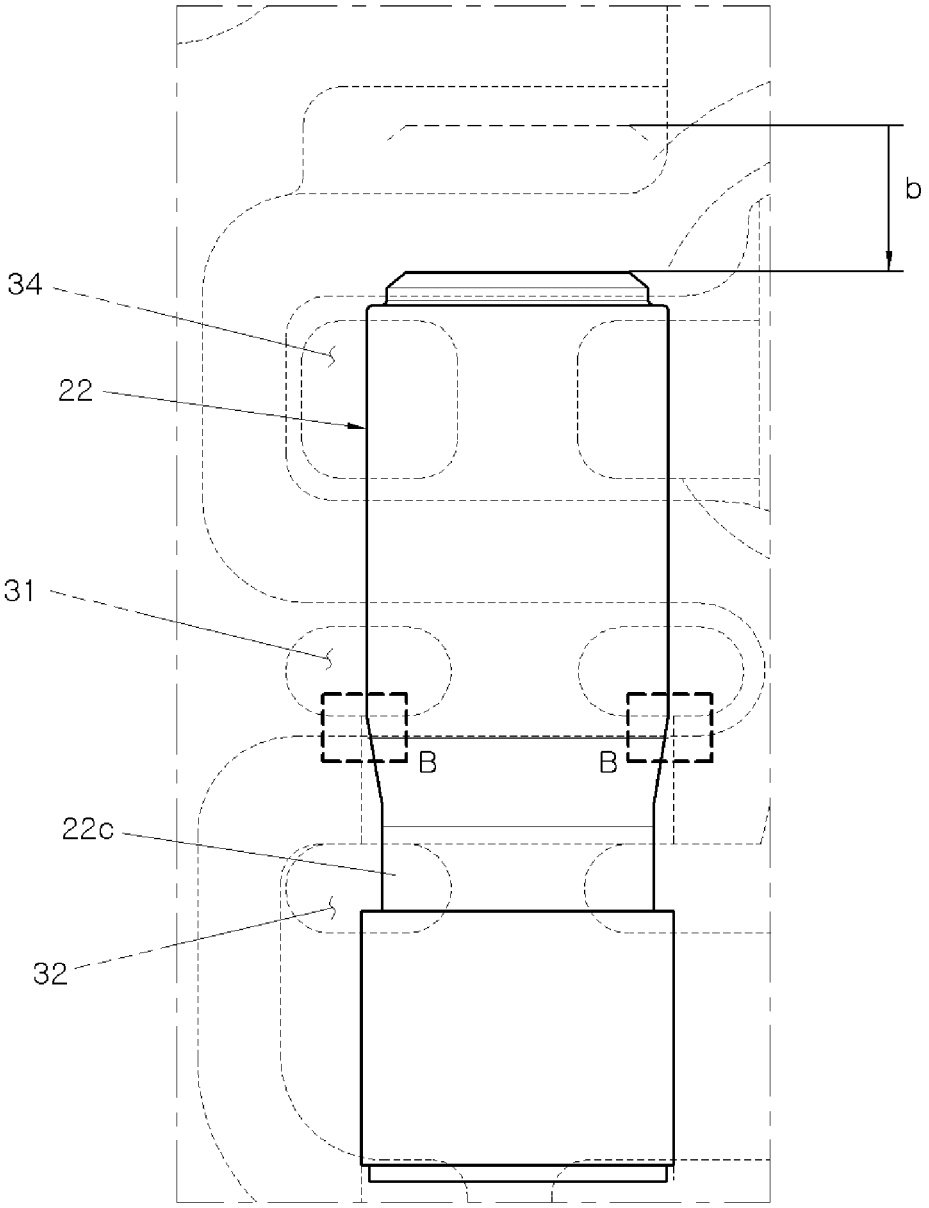

As shown in FIG. 5C, when the plunger 22 continues to descend so that the displacement of the plunger 22 becomes b (here, b>a), the upper body 22*a* of the plunger 22 completely blocks the first bypass inlet passage 31 (see Portion B of FIG. 5B) and thus the communication between the first bypass inlet passage 31 and the first bypass outlet passage 32 is interrupted so that the first bypass of the oil is terminated.

Figure 5D:
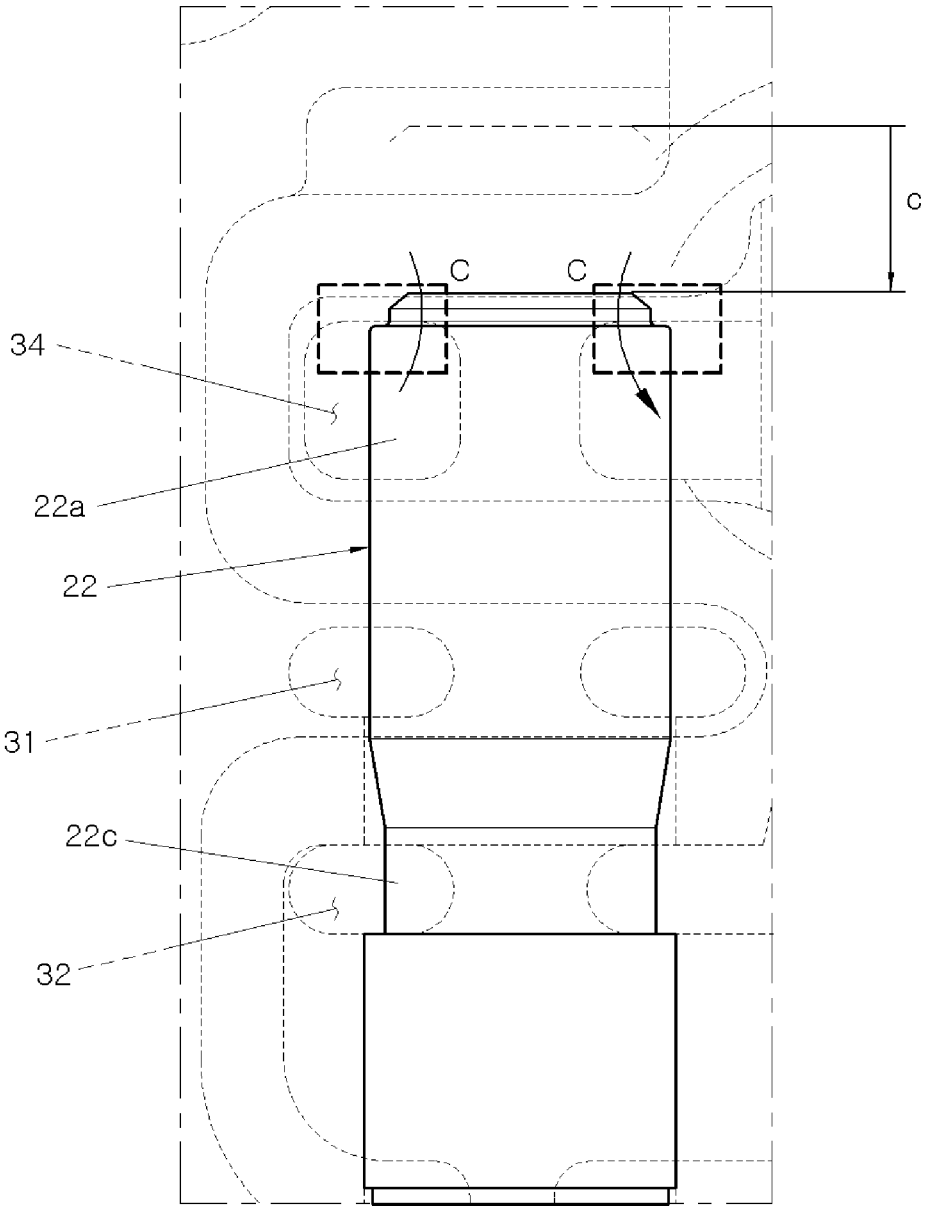

As shown in FIG. 5D, after the first bypass is terminated, the plunger 22 continues to further descend and thus when the displacement of the plunger reaches c (c>b), the upper body 22*a* opens the second bypass outlet passage 34 (see Portion C of FIG. 5D) to communicate the second bypass inlet passage 33 with the second bypass outlet passage 34 so that the second bypass is started.

From the moment when the plunger 22 is started to descend, the upper opening and closing portion 22*e* is separated from the second bypass inlet passage 33 and thus the second bypass inlet passage 33 is opened. However, since the upper body 22*a* blocks the second bypass outlet passage 34, the oil is not bypassed through the second bypass inlet passage 33 and the second bypass outlet passage 34. However, when the upper body 22*a* opens the second bypass outlet passage 34, the second bypass inlet passage 33 communicates with the second bypass outlet passage 34 so that the second bypass is possible.

In this case, a point in time at which the second bypass outlet passage 34 is opened may have an interval with respect to a termination point of time of the first bypass, that is, a point in time at which the blocking of the first bypass inlet passage 31 is completed. That is, when the plunger 22 descends to reach the displacement b to block the first bypass inlet passage 31 and then further descends until reaching the displacement c such that the second bypass outlet passage 34 is opened.

As described above, the bypass state for each displacement according to the descending of the plunger 22 is summarized as follows.

TABLE 1

| Bypass state | Displacement of plunger | First bypass inlet passage | First bypass outlet passage | Second bypass inlet passage | Second bypass outlet passage |
|---|---|---|---|---|---|
| No bypass | Zero | Opened | Blocked | Blocked | Blocked |
| Start of first bypass | a | Opened | Opened | Blocked | Blocked |
| Termination of first bypass | b | Blocked | Opened | Opened | Blocked |
| Start of second bypass | c | Blocked | Opened | Opened | Opened |

[Bypass State Due to Displacement of Plunger (Here, a<b<c)]

Here, states in which valve displacements are o, a, b, and c are shown in FIGS. 5A, 5B, 5C, and 5D, respectively.

As described above, since the interval is formed between the termination of the first bypass and the start of the second bypass, the flow rate and the pressure of the oil discharged from the oil pump 1 are recovered so that it prevents a phenomenon in which a low pressure of the oil is formed in a section in which the engine is operating at a high speed.

Figure 6:
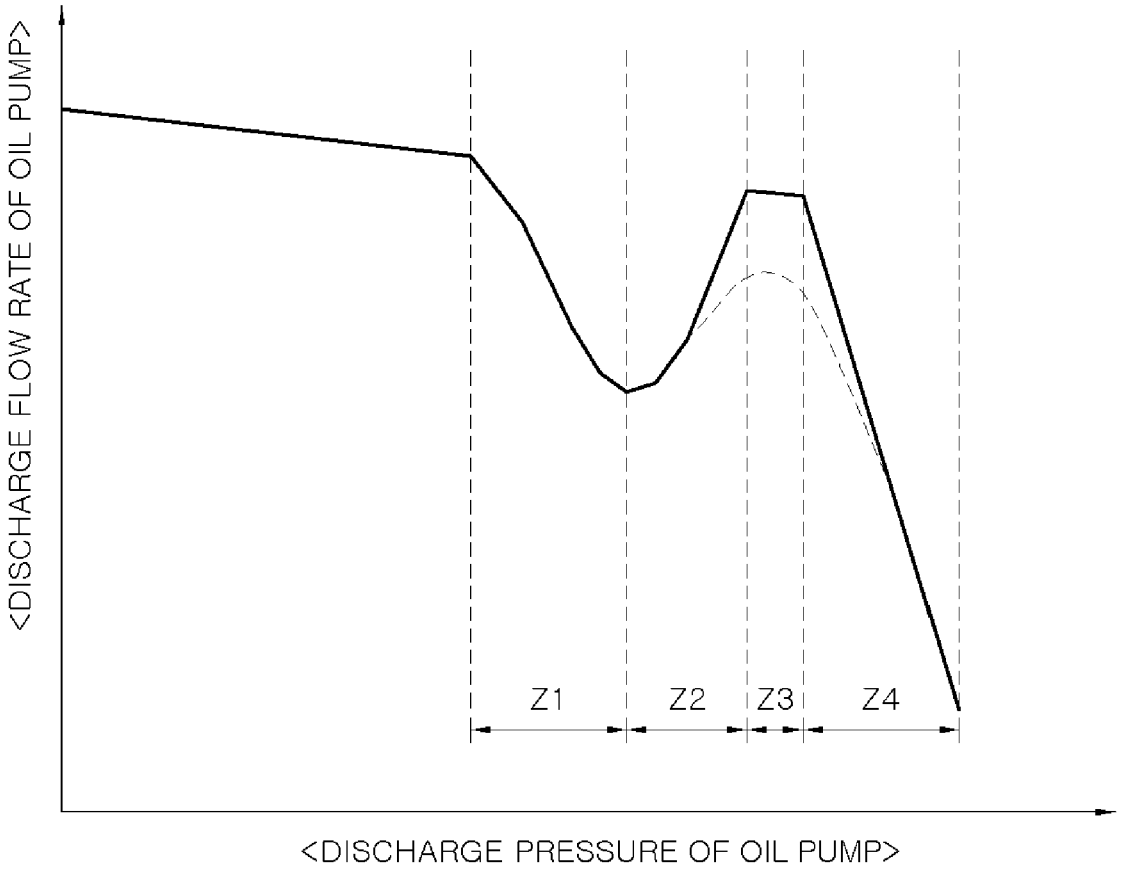
FIG. 6 is a graph showing a relationship between a discharge pressure and a discharge flow rate of the oil pump due to the relief valve assembly for an oil pump in which the bypass section is separated according to embodiments of the present disclosure.
Figure 7:
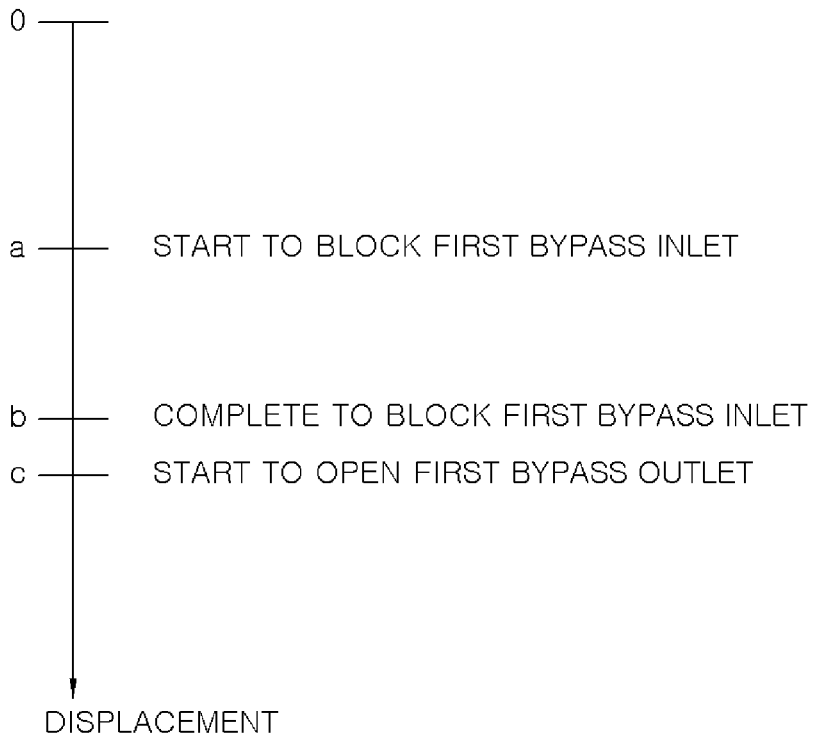
FIG. 7 is a schematic diagram illustrating a bypass state according to displacement of the plunger in the relief valve assembly for an oil pump in which the bypass section is separated according to embodiments of the present disclosure.

FIG. 6 illustrates a pressure and a flow rate of the oil discharged through the oil pump 1 according to the displacement of the plunger 22. In a section Z1 in which the first bypass is performed, the flow rate and the pressure of the oil discharged from the oil pump 1 are decreased due to the bypass of the oil. However, the first bypass is terminated (closing of the first bypass inlet passage) and the opened passages are blocked so that the decreased flow rate and the decreased pressure are restored (see a section Z2). Thereafter, until the secondary bypass is started (opening of the second bypass outlet passage), a state in which a bypass is not present is maintained (see a section Z3). Next, when the second bypass outlet 34 is opened and thus the second bypass is started, the flow rate and the pressure of the oil discharged from the oil pump 1 are decreased due to the second bypass (see a section Z4).

When the first bypass overlaps the second bypass or the first bypass and the second bypass proceed without an interval, the pressure and the flow rate of the oil are varied as shown by a dotted line of FIG. 6. Consequently, a sufficient flow rate and a sufficient pressure are not formed so that it is impossible to sufficiently supply the oil in a section in which the engine is operating at a high speed.

However, according to embodiments of the present disclosure, the interval is formed between the first bypass and the second bypass so that a sufficient flow rate and a sufficient pressure of the oil may be formed.

In accordance with a relief valve assembly for an oil pump having the above-described configuration in which a bypass section is separated according to embodiments of the present disclosure, since a first bypass section does not overlap a second bypass section or the first bypass section and the second bypass section are not continuous, oil having a sufficient flow rate and a sufficient pressure can be discharged from an oil pump after a first bypass is terminated and before a second bypass is started.

Accordingly, even in a section in which an engine is operating at a high speed, a phenomenon in which the pressure of the oil discharged from the oil pump is drastically decreased does not occur.

In particular, in the section in which the engine is operating at a high speed, the oil discharged from the oil pump is less affected due to a pressure even with variations in the external environment such as a variation in oil temperature and a variation in oil viscosity.

While the present disclosure has been described with respect to the specific embodiments, it will be apparent to those skilled in the art that various changes and modifications may be made without departing from the spirit and scope of the present disclosure as defined in the following claims. Accordingly, it should be noted that such alternations or modifications fall within the claims of the present disclosure, and the scope of the present disclosure should be construed on the basis of the appended claims.

What is claimed is:

1. A relief valve assembly for an oil pump, the relief valve assembly being installed on a bypass passage and configured to connect a discharge port and a suction port in the oil pump in which an outer rotor and an inner rotor are configured to rotate to be inscribed with each other and to control a pressure of oil discharged from the oil pump, the relief valve assembly comprising:

a plunger slidably installed in a valve housing formed on one side of the oil pump and configured to be elastically supported in a direction of blocking a flow of the oil; and a bypass inlet passage and a bypass outlet passage formed at two or more intervals to bypass the oil, the bypass inlet passage and the bypass outlet passage configured to open and close according to movement of the plunger while communicating the bypass passage with an interior of the valve housing, wherein the plunger is configured to move downward and, when the plunger moves downward, the bypass inlet passage and the bypass outlet passage, which communicate with each other, are configured to be blocked first, and then the bypass inlet passage is configured to communicate with the bypass outlet passage after a predetermined interval;

wherein the bypass inlet passage includes a first bypass inlet passage and a second bypass inlet passage formed above the first bypass inlet passage;

wherein the bypass outlet passage includes a first bypass outlet passage formed below the first bypass inlet passage and a second bypass outlet passage formed between the first bypass inlet passage and the second bypass inlet passage;

wherein the plunger includes an upper body and a lower body formed at a predetermined interval in a length direction of the plunger, the lower body being configured to open or close the first bypass outlet passage, the upper body being configured to open or close the first bypass inlet passage and the second bypass outlet passage;

wherein the plunger is configured to descend due to pressure of the oil discharged from the oil pump;

wherein the first bypass inlet passage is configured to be partially blocked and the second bypass outlet passage is configured to be blocked when the plunger is descended to a first position from an initial position;

wherein the first bypass inlet passage is configured to be fully blocked when the plunger is descended to a second position from the first position; and wherein the second bypass outlet passage is configured to open after a predetermined interval of time when the plunger is descended to a third position from the second position.

2. The relief valve assembly of claim 1, wherein a distance between the second position and the third position is in a range from 1 mm to 2 mm.

3. The relief valve assembly of claim 1, wherein at the second position of the plunger, an upper end of the upper body of the plunger is spaced apart from an upper end of the second bypass outlet passage.

4. The relief valve assembly of claim 3, wherein at the third position of the plunger, the upper end of the upper body is further spaced apart from the upper end of the second bypass outlet passage.

5. The relief valve assembly of claim 3, wherein the upper end of the second bypass outlet passage is formed below the plunger such that the upper end of the second bypass outlet passage is further spaced apart from the upper end of the upper body of the plunger.

6. The relief valve assembly of claim 1, wherein the plunger further comprises:

an inclined portion formed between the upper body and the lower body of the plunger and having a cross section that decreases from the upper body toward the lower body; and a lower opening portion formed between the inclined portion and the lower body and having a diameter equal to that of an end portion of the inclined portion.

7. The relief valve assembly of claim 1, wherein the plunger further comprises a tapered portion formed on a circumference of an upper end of the upper body in the plunger and having an inclined cross section.

8. The relief valve assembly of claim 3, wherein a distance between the second position and the third position is in a range from 1 mm to 2 mm.

9. The relief valve assembly of claim 4, wherein a distance between the second position and the third position is in a range from 1 mm to 2 mm.

10. The relief valve assembly of claim 5, wherein a distance between the second position and the third position is in a range from 1 mm to 2 mm.

11. The relief valve assembly of claim 6, wherein a distance between the second position and the third position is in a range from 1 mm to 2 mm.

12. The relief valve assembly of claim 7, wherein a distance between the second position and the third position is in a range from 1 mm to 2 mm.

13. A method of operating a relief valve assembly for an oil pump, the relief valve assembly being installed on a bypass passage of the oil pump, the method comprising:

unblocking a first bypass inlet passage and blocking a first bypass outlet passage, a second bypass inlet passage, and a second bypass outlet passage with a plunger of the relief valve assembly;

introducing oil discharged from the oil pump to the relief valve assembly through the bypass passage;

moving the plunger of the relief valve assembly in a downward direction by a first displacement to unblock the first bypass outlet passage using pressure of the oil discharged from the oil pump;

starting a first bypass of the oil by communicating the first bypass inlet passage and the first bypass outlet passage by descending the plunger;

moving the plunger of the relief valve assembly in the downward direction by a second displacement to block the first bypass inlet passage and unblock the second bypass inlet passage using pressure of the oil discharged from the oil pump;

terminating the first bypass of the oil by interrupting communication between the first bypass inlet passage and the first bypass outlet passage by descending the plunger;

moving the plunger of the relief valve assembly in the downward direction by a third displacement to unblock the second bypass outlet passage using pressure of the oil discharged from the oil pump; and starting a second bypass of the oil by communicating the second bypass inlet passage and the second bypass outlet passage by descending the plunger.

14. The method of claim 13, wherein the plunger is slidably installed in a valve housing formed on one side of the oil pump.

15. The method of claim 14, wherein the plunger is elastically supported by a holder and a spring.

16. The method of claim 13, wherein prior to introducing the oil to the relief valve assembly, the method further comprises:

introducing the oil into the oil pump through a suction port;

rotating an outer rotor and an inner rotor to pressurize the oil; and discharging the pressurized oil from the oil pump through a discharge port, wherein a portion of the pressurized oil is the oil introduced to the bypass passage.

17. The method of claim 13, wherein a distance between the second displacement and the third displacement is about 1 mm.

18. An oil pump comprising:

a housing;

an outer rotor and an inner rotor in the housing, the outer rotor and the inner rotor configured to rotate to be inscribed with each other;

a relief valve assembly comprising a valve housing formed on one side of the oil pump, a plunger slidably installed in the valve housing, a first bypass inlet passage, a second bypass inlet passage formed above the first bypass inlet passage, a first bypass outlet passage formed below the first bypass inlet passage, and a second bypass outlet passage formed between the first bypass inlet passage and the second bypass inlet passage; and a bypass passage in the housing and connected to an upper end of the valve housing, wherein the plunger comprises:

an upper body;

a lower body;

an inclined portion formed between the upper body and the lower body and having a cross section that decreases from the upper body toward the lower body;

a lower opening portion formed between the inclined portion and the lower body and having a diameter equal to that of an end portion of the inclined portion; and a tapered portion formed on a circumference of an upper end of the upper body and having an inclined cross section.

19. The oil pump of claim 18, wherein the plunger is configured to be elastically supported by a holder and a spring of the relief valve assembly.

20. The oil pump of claim 18, wherein the plunger is configured to descend in the valve housing due to pressure of the oil discharged from the oil pump, and wherein the oil pump is configured to operate so that:

prior to descending of the plunger at an initial position, the first bypass inlet passage is unblocked and the first bypass outlet passage, the second bypass inlet passage, and the second bypass outlet passage are blocked by the plunger;

at a first descent point of the plunger descended from the initial position, the first bypass inlet passage and the first bypass outlet passage are unblocked, and the second bypass inlet passage and the second bypass outlet passage are blocked by the plunger;

at a second descent point of the plunger more descended from the first descent point, the first bypass inlet passage and the second bypass outlet passage are blocked by the plunger, and the first bypass outlet passage and the second bypass inlet passage are unblocked; and at a third descent point of the plunger more descended from the second descent point, the first bypass inlet passage is blocked by the plunger, and the first bypass outlet passage, the second bypass inlet passage, and the second bypass outlet passage are unblocked.

* * * * *